US011773604B1

(12) United States Patent
Morris et al.

(10) Patent No.: US 11,773,604 B1
(45) **Date of Patent: *Oct. 3, 2023**

(54) MOISTURE RESISTANT ENGINEERED HARDWOOD VENEER FLOORING

(71) Applicant: Columbia Insurance Company, Omaha, NE (US)

(72) Inventors: Roman Morris, Simpsonville, SC (US); Chris Andrews, Signal Mtn, TN (US); David Hahn, Simpsonville, SC (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/890,384

(22) Filed: Aug. 18, 2022

Related U.S. Application Data

(63) Continuation of application No. 16/657,328, filed on Oct. 18, 2019, now Pat. No. 11,454,036.

(60) Provisional application No. 62/747,478, filed on Oct. 18, 2018.

(51) Int. Cl.
*E04F 15/02* (2006.01)
*E04F 15/04* (2006.01)

(52) U.S. Cl.
CPC ..... *E04F 15/042* (2013.01); *E04F 15/02038* (2013.01); *E04F 2201/023* (2013.01); *E04F 2201/03* (2013.01); *E04F 2290/00* (2013.01)

(58) Field of Classification Search
CPC ... E04F 15/02038; E04F 15/10; E04F 15/102; E04F 15/105; E04F 15/107; E04B 1/644; E04B 1/665
USPC ..... 52/515, 516, 588.1, 581, 582.1
See application file for complete search history.

(56) References Cited

U.S. PATENT DOCUMENTS

| | | | | |
|---|---|---|---|---|
| 6,922,965 | B2 | 1/2005 | Rosenthal et al. | |
| 2001/0034991 | A1* | 11/2001 | Martensson | E04F 13/0878 52/578 |
| 2003/0068447 | A1* | 4/2003 | Carling | C09D 175/16 427/535 |
| 2004/0031225 | A1 | 2/2004 | Fowler | |
| 2004/0038062 | A1* | 2/2004 | Wilson | B27K 3/15 428/528 |
| 2004/0058089 | A1* | 3/2004 | Forster | E04F 15/02194 427/407.1 |
| 2004/0192141 | A1 | 9/2004 | Yang et al. | |
| 2004/0211144 | A1* | 10/2004 | Stanchfield | E04F 13/08 52/311.1 |
| 2004/0241416 | A1* | 12/2004 | Tian | D06N 7/0013 428/161 |
| 2005/0136276 | A1 | 6/2005 | Borup et al. | |
| 2006/0024465 | A1 | 2/2006 | Briere | |
| 2006/0144012 | A1 | 7/2006 | Manning et al. | |
| 2007/0039268 | A1 | 2/2007 | Ambrose et al. | |
| 2007/0044412 | A1* | 3/2007 | Forster | B29D 99/0057 52/592.1 |
| 2009/0260313 | A1 | 10/2009 | Segaert | |
| 2010/0190031 | A1* | 7/2010 | Questel | C04B 41/52 427/508 |

(Continued)

FOREIGN PATENT DOCUMENTS

WO WO 2012/006200 A1 1/2012

*Primary Examiner* — Kyle J. Walraed-Sullivan
(74) *Attorney, Agent, or Firm* — Ballard Spahr LLP

(57) ABSTRACT

Disclosed are moisture resistant engineered hardwood veneer flooring panels. Also disclosed are methods for making same.

19 Claims, 11 Drawing Sheets

(56) References Cited

U.S. PATENT DOCUMENTS

| | | | | |
|---|---|---|---|---|
| 2010/0319291 | A1* | 12/2010 | Pervan | E04F 21/22 52/745.21 |
| 2013/0064072 | A1 | 3/2013 | Vasseur et al. | |
| 2013/0065072 | A1* | 3/2013 | Pervan | B32B 21/08 428/537.1 |
| 2013/0067840 | A1 | 3/2013 | Martensson et al. | |
| 2013/0101861 | A1* | 4/2013 | Cao | C09D 4/00 522/78 |
| 2013/0104478 | A1 | 5/2013 | Meersseman et al. | |
| 2013/0104485 | A1 | 5/2013 | Meersseman et al. | |
| 2013/0192158 | A1 | 8/2013 | Cappelle et al. | |
| 2013/0295346 | A1* | 11/2013 | Ferguson | E04F 15/163 156/331.7 |
| 2015/0086747 | A1 | 3/2015 | Beuchel et al. | |
| 2016/0047130 | A1 | 2/2016 | MacQueen | |
| 2016/0153190 | A1 | 6/2016 | Doehring | |
| 2016/0168868 | A1 | 6/2016 | Song | |
| 2016/0289953 | A1 | 10/2016 | Silvers et al. | |
| 2016/0319553 | A1* | 11/2016 | Lautzenhiser | B32B 5/024 |
| 2016/0368276 | A1* | 12/2016 | Potter | B44C 5/04 |
| 2017/0328073 | A1 | 11/2017 | Saladino et al. | |
| 2019/0003189 | A1 | 1/2019 | Dohring | |
| 2020/0055084 | A1* | 2/2020 | Tian | B05D 7/58 |
| 2020/0101710 | A1* | 4/2020 | Clausi | B44C 5/04 |

* cited by examiner

MOISTURE RESISTANT ENGINEERED HARDWOOD VENEER FLOORING

CROSS-REFERENCE TO RELATED APPLICATIONS

This Application is a continuation of U.S. Non-Provisional application Ser. No. 16/657,328, filed Oct. 18, 2019, which claims the benefit of U.S. Provisional Application No. 62/747,478 filed Oct. 18, 2018, which is incorporated herein by reference in its entirety.

TECHNICAL FIELD

This invention relates generally to engineered hardwood floor covering panels for use in commercial, industrial or residential environments. More particularly, this invention relates to engineered hardwood veneer floor covering panels having a moisture barrier composition applied to a plurality of different surfaces and edges in a manner that improves resistance to moisture.

BACKGROUND

Commercially available floorings, also known as engineered wood floorings, such as multiple cross-laminated veneers, face veneers on high density fiberboard (HDF) core, wood-polymer composite (WPC) core, or stone polymer composite (SPC) core have gained overwhelming success in the flooring market. These layered constructions are typically formed into standard-sized panels which are joined together at an installation site to create a floor covering system Though the veneer layer of such flooring systems is frequently coated with a water resistant or water tight material, the floor coverings systems can be still vulnerable to water damage at various joints points. Slight imperfections in the fit (seam) between adjacent floor panels may allow water or other liquids to penetrate into the joints between floor panes, which may in, in turn, result in damage, warpage, accelerated wear, or deteriorated fit of individual floor panels. Moreover, cleaning materials generally comprise surfactants that may accelerate the seepage of water into the seam. Because the material that make up the inner layers of the floor panels may not be completely impervious to water, those layers may absorb water or other fluids, resulting in damage or decreased product life.

In actual residential and commercial settings, wood floorings are often contacted with liquids, either deliberately or through accident. Cleaning of floors with a detergent solution may cause up to as much as a 35% swelling of the flooring at the seam. Accidental wetting may also occur from spills or animal or human urine. Each of the liquids has a lower surface tension than water and will be likely to migrate into the seam formed by mating of two floor covering panels so as to cause engineered wood following to swell and eventually become dimensionally unstable. Also it is known that excess of moisture in hardwood or engineered wood floors can lead to splinters, splits, and face checking, mold and mildew growth that can also have a deleterious effect on human health.

At least 98% of the engineered wood flooring sold in the US is pre-finished. Manufacturers commonly use flatbed finish lines that move boards via belts/rollers past roll coaters that apply finishes to the face. Applying moisture resistant sealer to the edges of the flooring boards prior to finishing, however, can be a problem if the sealer gets on the bevel as the sealer prevents stain from penetrating into the wood. This results in flooring boards that have unequal stain color on the veneer and on the bevel. Often to prevent sealers from getting on the face/bevels, the manufacturers need to use precision mounts that make this process more expansive.

As result, a need exists in the industry for a simpler solution that allows application of a moisture resistant sealer in a single pass at production speeds. The disclosed methods providing moisture resistant engineered wood flooring allow to reduce the amount of water that seeps or penetrates into the surface of the floor, allow more time to clean up topical spills before damage can occur and increase the life of the hardwood floor.

SUMMARY

The present disclosure is directed generally to engineered hardwood veneer flooring panels having increased resistance to moisture due to the application of a moisture barrier composition on one or more surface of the flooring panel.

In one aspect, the disclosed flooring panel comprises a composite panel structure having a decorative veneer layer and a core layer, the veneer layer and the core layer having respective top surfaces and opposed bottom surfaces, wherein the veneer layer bottom surface overlies the core layer top surface. The composite panel structure has a first pair of opposing side edges that extend between the core layer bottom surface and the veneer layer top surface; and a second pair of opposing side edges that extend between the core layer bottom surface and the veneer layer top surface. Further, any two or more of the veneer layer top surface, the core layer bottom surface, the first pair of opposing side edges, and the second pair of opposing side edges further comprises a moisture barrier composition applied thereto In another aspect, disclosed is a method of making the engineered hardwood veneer flooring panels disclosed and described herein. The method generally comprises forming a composite panel structure by applying the veneer layer to the core layer such that the veneer layer bottom surface overlies the core layer top surface and such that a first pair of opposing side edges extends between the core layer bottom surface and the veneer layer top surface and a second pair of opposing side edges extends between the core layer bottom surface and the decorative veneer layer top surface; and applying a moisture barrier composition to any one or more of the veneer layer top surface, the core layer bottom surface, the first pair of opposing side edges, and the second pair of opposing side edges.

Additional aspects of the invention will be set forth, in part, in the detailed description, figures, and claims which follow, and in part will be derived from the detailed description, or can be learned by practice of the invention. It is to be understood that both the foregoing general description and the following detailed description are exemplary and explanatory only and are not restrictive of the invention as disclosed.

DETAILED DESCRIPTION

Figure 1:
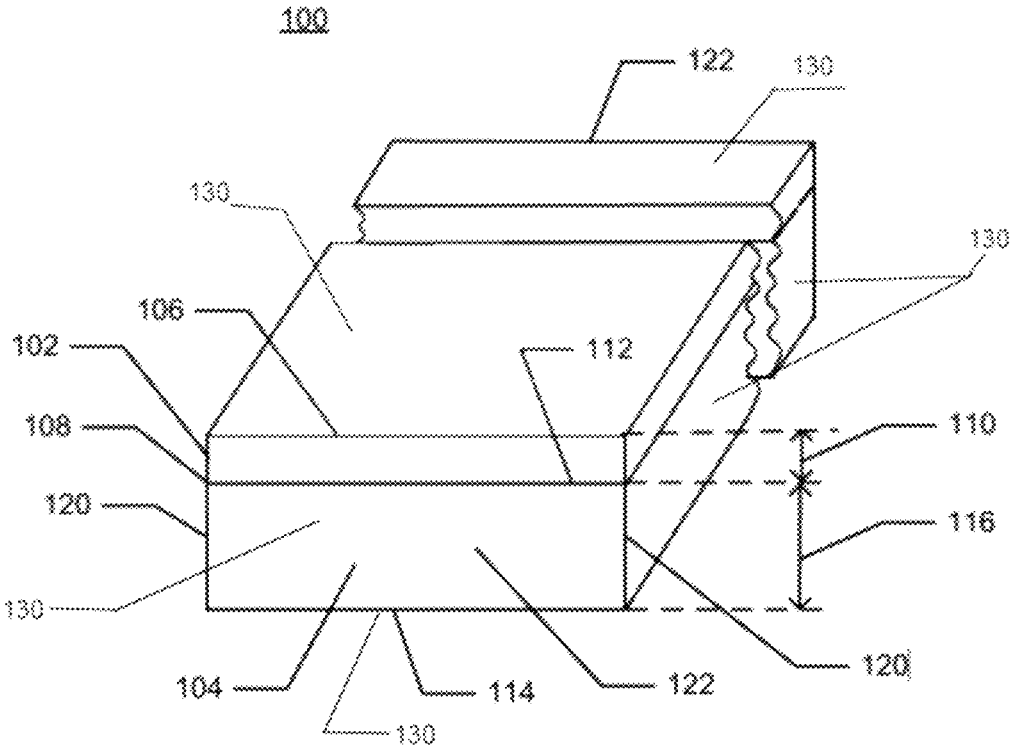
FIG. 1 depicts a perspective view of an exemplary engineered hardwood veneer flooring panel having a barrier composition applied to at least the top and bottom surface thereof.

The present invention can be understood more readily by reference to the following detailed description, examples, drawings, and claims, and their previous and following description. However, before the present articles, systems, and/or methods are disclosed and described, it is to be understood that this invention is not limited to the specific or exemplary aspects of articles, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

Definitions

In this specification and in the claims that follow, reference will be made to a number of terms, which shall be defined to have the following meanings:

Throughout the description and claims of this specification the word "comprise" and other forms of the word, such as "comprising" and "comprises," means including but not limited to, and is not intended to exclude, for example, other additives, components, integers, or steps. Furthermore, it is to be understood that the terms comprise, comprising and comprises as they related to various aspects, elements and features of the disclosed invention also include the more limited aspects of "consisting essentially of" and "consisting of."

As used herein, the singular forms "a," "an" and "the" include plural referents unless the context clearly dictates otherwise. Thus, for example, reference to a "surface" includes aspects having two or more such surfaces unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As disclosed herein, the term "core layer" refers to any composite material capable withstanding heavy duty applications, such as for example, heavy foot traffic, without any significant deformation of the flooring panel. The composite material can be any material, including exemplary materials such as plywood, densified fiber, wood-polymer composites (WPC), stone-polymer composite (SPC), thermoplastic, thermoset composites, or any combination thereof. Still further, in aspects of the disclosure, a core layer can be defined functionally in that it at least substantially prevents telegraphing of hard surface subfloor structure irregularities, such as ripples and waves, to the veneer layer portion when the floor covering is abutting the subfloor structure in the selected orientation. The rigidity of the composite core layer can, for example, be defined by its tensile modulus. It is understood that the rigid composite core layer can exhibit a tensile modulus that exceeds $10^5$ psi (or 689 MPa). The composite core layer is defined as semi-rigid when its tensile modulus falls between $3\times10^3$ and $10^5$ psi (20.7 MPa), and flexible when it has a tensile modulus that is less than $3\times10^3$ psi (or 20.7 MPa) (the tensile modulus values are based on standard ASTM conditions of 23° C. and 50% relative humidity).

As used herein, the term side edge locking mechanism or structure refers to a profiled edge the forms a locking connection between two adjacent panels such that the two adjacent panels are affixed in a manner that prevents relative lateral or horizontal separation between the two panels. In some aspects, a side edge locking structure can be an interlocking structure or mechanism as described herein. A conventional click lock mechanism is an example of a side edge locking structure. In contrast, it should be understood that conventional tongue and groove profiles that only restrict vertical movement of adjacent panels is not to be considered a side edge locking structure as the tongue and groove profile does not restrict lateral or horizontal displacement. It should therefore be understood that as used herein, aspects that specifically disclaim a side edge locking structure can still include (do not exclude) aspects where, for example, the side edge simply abuts another a side edge in view of having no special profile and also include aspects having conventional tongue and groove profiles.

As used herein, the terms "interlocking mechanism" or "interlocking structure" refer to locking means which lock adjacent floor covering boards together in manner which restricts or prevents at least a horizontal separation of two adjacent interlocked board. This can also include aspects that prevent both a horizontal or lateral separation and relative vertical displacement. Some exemplary interlocking mechanisms contain both a tongue type protrusion and a groove like profile within the same flooring covering board, such as, for example, a click lock type profile. For example, the tongue type profile can be machined into one side and one end of the board with the groove like profile being machined into the opposite side and end of the same panel. Such joints can be made by machining the edges of the boards. Alternatively, parts of the interlocking mechanism can be made of a separate material which is then integrated with the floor covering board. It is understood that the term "interlocking mechanism" is not construed to be limited to only profiles or feature that are integral to the floor covering boards. Other exemplary interlocking mechanisms include snapping connections incorporated into the board edges, angling board with interlocking edges, boards with overlapping edges, boards with the puzzle-lock edges, boards with slopping edges etc. It is understood that the term "interlocking mechanism" allows a plurality of panels to be readily joined in interlocking relationship such that when assembled, there is no necessity for separate structural frames.

Besides the locking means provided by the floor covering boards, the interlocking mechanism, as defined herein, can further include locking elements. In some examples, such locking elements can include strips with salient features that engage the locking element onto two adjacent flooring panels. Such locking devices can be made of the same material as a floor covering panel, aluminum, wood fiber, etc.

The present invention may be understood more readily by reference to the following detailed description of preferred embodiments of the invention and the examples included therein and to the Figures and their previous and following description.

Flooring Panel

As summarized above, the disclosed flooring panel comprises a core layer having a top surface and an opposed bottom surface and a decorative veneer layer having a top surface and an opposing bottom surface. In certain aspects described herein, the decorative veneer layer overlies the core layer top surface. In further aspects, the flooring panel comprises a first pair of opposing side edges extending between the core layer bottom surface and the decorative veneer layer top surface. In still further aspects, the flooring panel comprises a second pair of opposing side edges extending between the core layer bottom surface and the decorative veneer layer top surface. The exemplary flooring panel is shown in FIG. 1. The top veneer layer 102, having a top surface 106 and an opposing bottom surface 108, overlies the core layer 104 having a top surface 112 and an opposing bottom surface 114. The veneer layer has a thickness of 110 and the core layer has a thickness of 116. The exemplary flooring panel further comprises a first pair of opposing side edges 120 and a second pair of opposing side edges 122. Any one or more of the veneer layer top surface 106, the core layer bottom surface 114, the first pair of opposing side edges 120, and the second pair of opposing side edges can further comprise a moisture barrier composition 130 applied thereto. In a further aspect, each of the veneer layer top surface 106, the core layer bottom surface 114, the first pair of opposing side edges 120, and the second pair of opposing side edges comprise a moisture barrier composition 130 applied thereto.

Figure 2A:
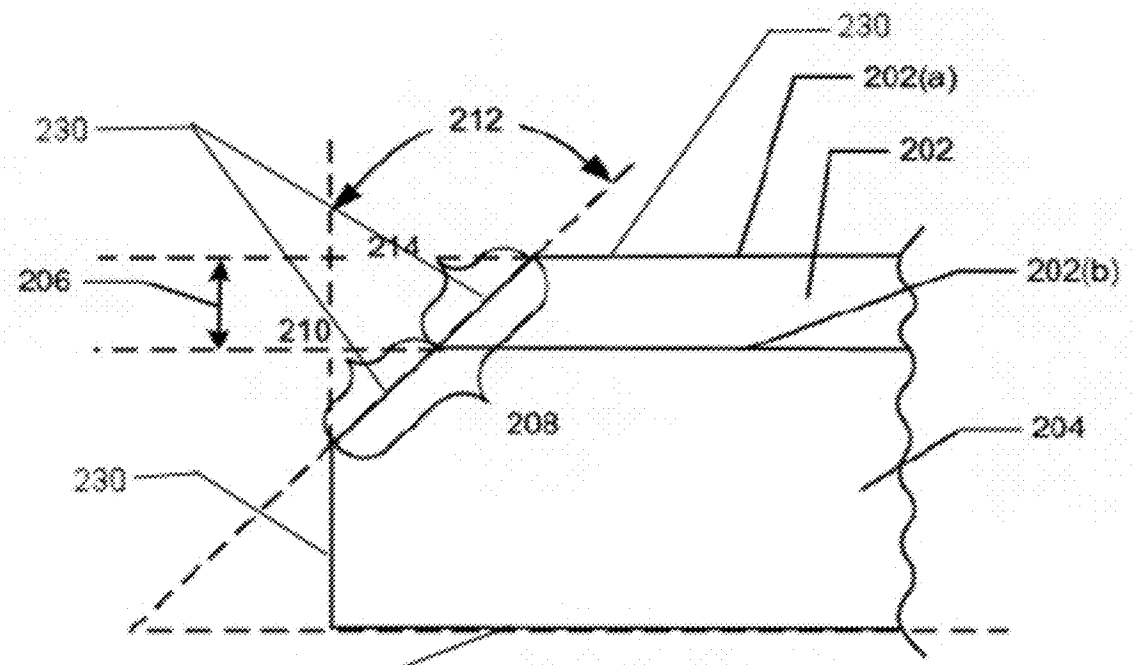
FIG. 2A depicts a side view illustration of an exemplary beveled side edge of an engineered hardwood veneer flooring panel of the present disclosure where the bevel surface extends below the decorative veneer layer bottom surface.
Figure 2B:
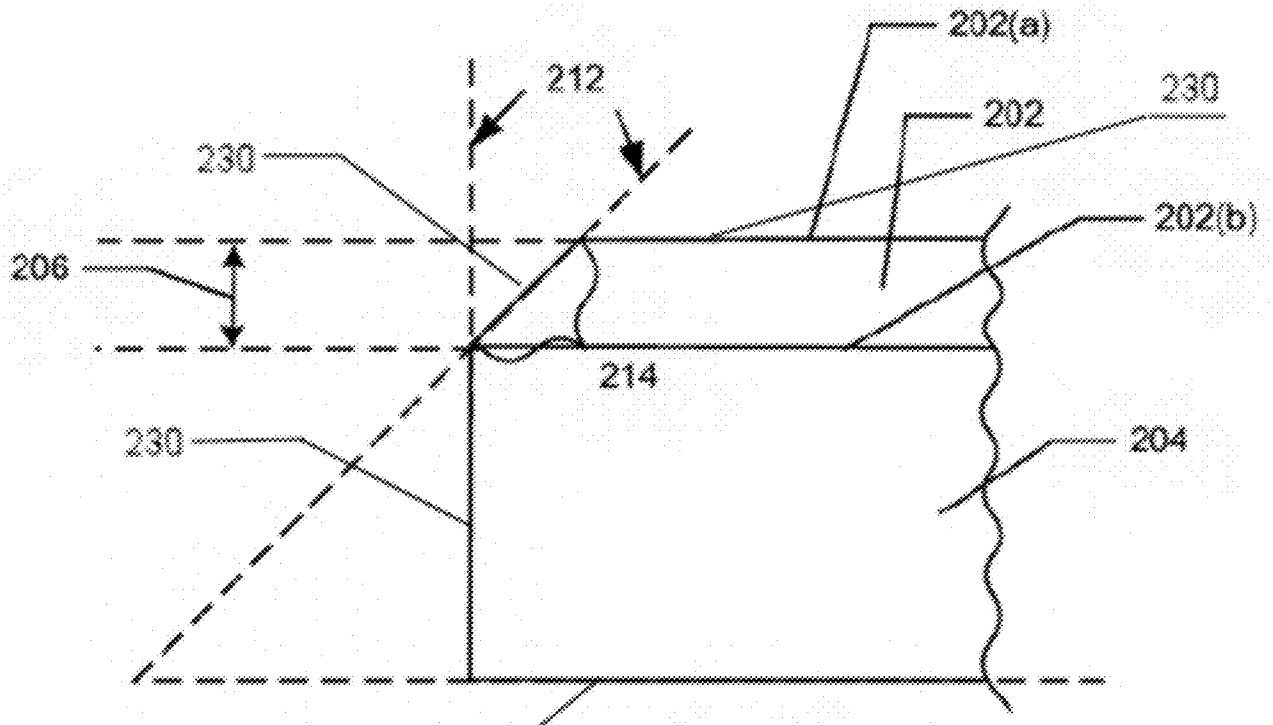
FIG. 2B depicts a side view illustration of an exemplary beveled side edge of an engineered hardwood veneer flooring panel of the present disclosure where the bevel surface extends a distance no further than the decorative veneer layer bottom surface.

In further aspects, each side edge of the first pair and/or second pair of opposing side edges can optionally have an upper beveled portion, the upper bevel portion forming a bevel surface that extends downward and outward a distance from the decorative veneer layer top surface. In some exemplary aspects, as shown in FIG. 2A, the veneer layer 202 having a thickness 206 overlies the core layer 204. The beveled surface 208 extends from the decorative veneer layer top surface 202*a* a distance 210 below the decorative veneer layer bottom surface 202*b*. The beveled portion of the flooring panel can have any angle (gradient) 212 that is suitable for a desirable application. In other exemplary aspects, as shown in FIG. 2B, the veneer layer 202 having a thickness 206 overlies the core layer 204. The beveled portion forming a beveled surface 214 extends from the decorative veneer layer top surface 202*a* a distance no further than to the decorative veneer layer bottom surface 202*b*. The beveled portion of the flooring panel can again have any angle (gradient) 212 that is suitable for a desirable application.

It is to be understood that in some aspects, where the beveled surface extends from the decorative veneer layer top surface a distance no further than the decorative veneer layer bottom surface, the core layer is not exposed. It is further understood that this beveled surface does not have to be fully extended between the top and bottom surfaces of the decorative veneer layer and can therefore extend a distance short of the veneer layer bottom surface. In still other aspects, the beveled surface extends the distance that is substantially similar to the thickness of the decorative veneer layer. In still further aspects, the beveled surface extends the distance that is smaller than the thickness of the decorative veneer layer.

Forming a beveled surface provides for several advantages. First, a beveled surface can provide desired aesthetic qualities to a flooring panel. Additionally, the beveled surfaces allow the panels, as they are rotated, both when rotating into one another and when rotating out of one another, be moved more easily in relation to one another, as there are no angular edges anymore which hinder the mutual rotation of the panels. In yet other aspects, the beveled surfaces allow to manufacture heavier panels, in particular thicker than usual, as the thickness of the panels, thanks to the bevel, has little or no influence anymore on the good working order of the above-mentioned coupling means, during the rotating in and/or the rotating out.

In certain aspects, the flooring panels can have any size or shape known in the art. In some aspects, the flooring panel can have a rectangular shape, a square shape, a triangular shape, or it can have any known in the art shape. In still other aspects, the flooring panels are rectangular. In certain aspects, the flooring panels have a width from about 3 inches to about 12 inches, including exemplary values of about 4 inches, about 5 inches, about 6 inches, about 7 inches, about 8 inches, about 9 inches, about 10 inches, about 11 inches, and about 12 inches. In still further aspects, the flooring panels have a length from about 12 inches to 84 inches, including exemplary aspects of about 15 inches, about 20 inches, about 25 inches, about 30 inches, about 35 inches, about 40 inches, about 45 inches, about 50 inches, about 55 inches, about 60 inches, about 65 inches, about 70 inches, about 75 inches, and about 80 inches.

In certain aspects, the angle (or a gradient) of an optional beveled portion can be any angle suitable for the application and is readily determined by one of ordinary skill in the art. In some exemplary aspects, the angle comprises about 85°, about 80°, about 75°, about 70°, about 65°, about 60°, about 55°, about 50°, about 45°, about 40°, about 35°, about 30°, about 25°, about 20°, or about 15°. In yet other aspects, the angle is about 45°.

In certain aspects, the beveled surface can extend, in a horizontal direction, over a distance from about 0.1 mm to about 3.0 mm, including exemplary values of about 0.5 mm, about 1 mm, about 1.2 mm, about 1.5 mm, about 1.8 mm, about 2 mm, about 2.2 mm, about 2.5 mm, and about 2.8 mm. Practically, the beveled surfaces extend, in a horizontal direction, over a distance of at least about 1 mm, at least about 2 mm, or at least 3 mm.

In some aspects, and as illustrated in FIG. 1 and FIG. 2A and FIG. 2B, the opposing side edges are not profiled to define any form of an interlocking or other connecting or fastening mechanism by which adjacent floor covering boards can be attached to one another. However, in alternative aspects, the opposing side edges can be profile to define any form of an interlocking or other fastening mechanism by which adjacent floor covering boards can be attached to one another. In some exemplary aspects, the opposing side edges can comprise connecting structures. In some aspects, the first pair of opposing side edges define a complementary connecting structure. In some aspects, a first side edge of the first pair of opposing side edges can define a tongue structure. In yet other aspects, a second side edge of the first pair of opposing side edges can define a groove structure. In still further aspects, the second pair of opposing side edges can also define a complementary connecting structure. In such aspects, a first side edge of the second pair of opposing side edges can define, for example, a tongue structure and a second side edge of the second pair of opposing side edges a groove structure.

In certain aspects complementary connecting structures allow each panel to be mutually coupled to one another, whereby these connecting structures provide for an interlocking in a direction perpendicular to the plane of the floor covering, as well as in a direction perpendicular to the edges concerned and parallel to the plane of the floor covering.

Figure 3A:
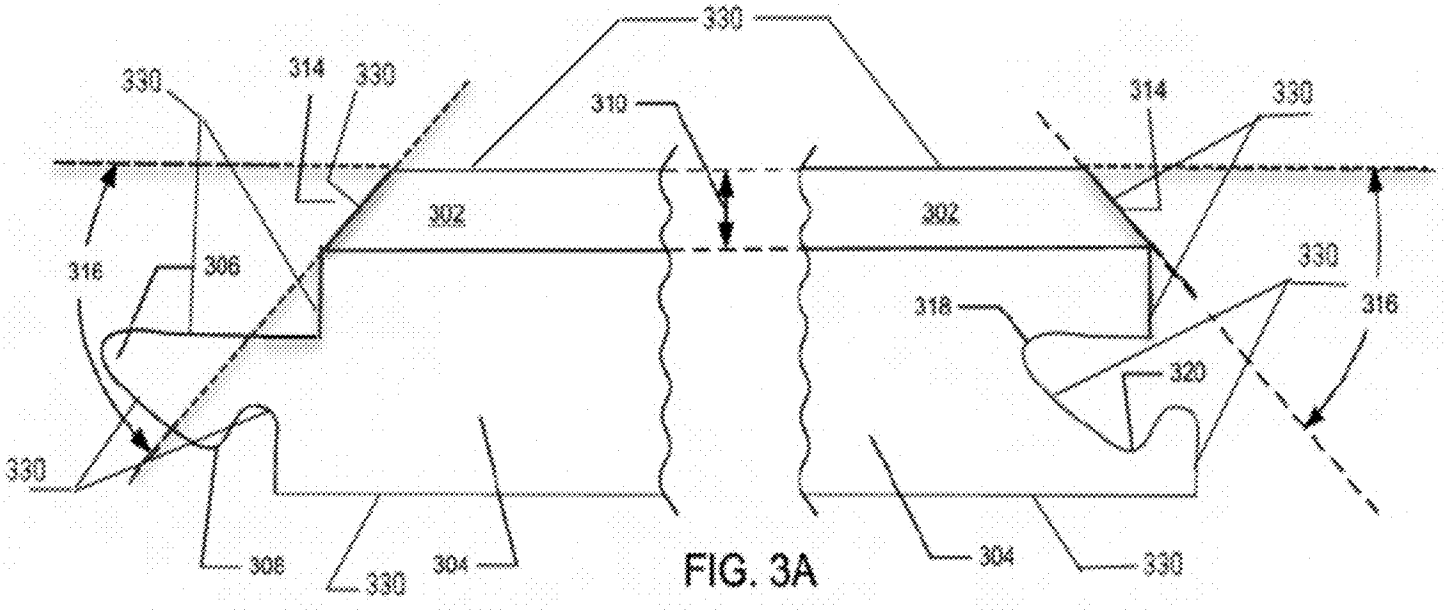
FIG. 3A depicts a side view illustration of an exemplary engineered hardwood flooring panel having a click lock interlocking profiled side edge connection features in an uncoupled mode.
Figure 3B:
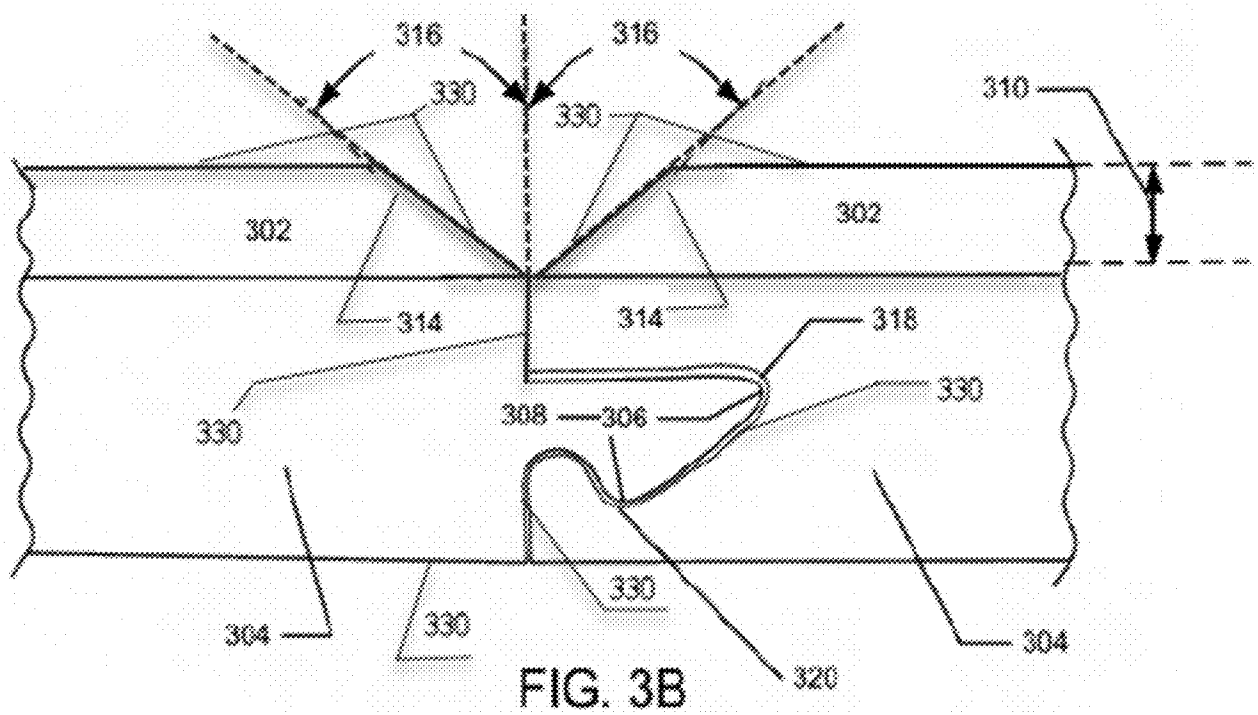
FIG. 3B depicts a side view illustration of an exemplary engineered hardwood flooring panel having a click lock interlocking profiled side edge connection features in a coupled mode. In both instances, the panel further illustrates optional beveled side edges and the presence of a moisture barrier composition as described herein.

Exemplary and non-limiting flooring panels comprising complementary connecting structures are shown on FIG. 3A and FIG. 3B. FIG. 3A shows a flooring panel having a complementary connecting structure prior to coupling to an adjacent flooring panel. FIG. 3B shows a coupling of two adjacent flooring panels. The flooring panel comprises a decorative veneer layer 302 having a thickness of 310 and overlying the core layer 304. A first side edge of the first pair of opposing side edges defines a tongue structure 306 and an optional locking mechanism 308. A second side edge of the first pair of opposing side edges defines a groove structure 318 and an optional locking mechanism 320. An optional beveled surface 314 is also shown forming an angle (gradient) 316 with the top surface of the decorative veneer layer. A moisture barrier composition 330 is also shown and can optionally be applied to any or all of the veneer top surface, bevel surface, core layer bottom surface, and side edges.

As is further represented in FIG. 3B, the beveled surfaces of each panel fit up to one another when the panels are coupled, and thus form a mutual stop. In certain aspects, the decorative bevel coloring material can also be moisture-proof and liquid and gas impermeable. In such aspects, the bevels can provide an additional sealing, which can be particularly useful when the panels have a porous core, for example made of MDF or HDF.

Core Layer

In some aspects, the core layer of the present invention can comprise any composite materials that provides a desirable rigidity. In some exemplary aspects, the core layer can be made of plastic, rubber, wood and plastic composite, mineral, wood or a fiber based material.

In certain aspects, the core layer comprises a stone polymer material (SPC). In other aspects, the core layer comprises a wood polymer composite material (WPC). In other aspects, the core layer is a mineral core layer composite substantially comprised of a mineral core material, such as magnesium oxide (MgO). The mineral core material as used herein can, for example, comprise MgO. In yet other aspects such mineral core can further comprise magnesium chloride MgCl or magnesium sulfide MgS. In certain aspects, the mineral core is formed by reacting MgO and MgCl (or MgS) with water. In yet other aspects, the mineral core can comprise a binder present in an amount from about 5 wt % to about 10 wt %, including exemplary values of about 6 wt %, about 7 wt %, about 8 wt %, and about 9 wt %.

In still further aspects, the core layer comprise medium density fiberboard (MDF) or a high density fiberboard (HDF) wood composite material. In these aspects, both HDF and MDF are engineered wood products. In some aspects, the HDF core layer can be prepared from wood fiber extracted from chips and pulped wood waste. In certain aspects, the HDF has a density greater than 50 $lb/ft^3$, including exemplary values of greater than 60 $lb/ft^3$, 70 $lb/ft^3$, 80 $lb/ft^3$, 90 $lb/ft^3$, or greater than 100 $lb/ft^3$. In certain aspects, to improve water resilience of the HDF based core layer, processing oils can be added during the board formation under high temperature and pressure. In other aspects, the MDF can be prepared from wood wastage fibers glued together with resin or glued under heat and pressure. In certain aspects, the MDF has a density of 30 to 50 $lb/ft^3$, including exemplary values of 35 $lb/ft^3$, 40 $lb/ft^3$, and 45 $lb/ft^3$.

In certain aspects, the core layer can comprise a densified fiber batt. In some aspects, the densified fiber batt has a density of from about 5 $lb/ft^3$ to about 100 $lb/ft^3$, including exemplary densities of 10, 15, 20, 25, 30, 35, 40, 45, 50, 55, 60, 65, 70, 75, 80, 85, 90, and 95 $lb/ft^3$. In still further aspects, the volumetric density can be a value within any range derived from the above values, including for example, a density of from about 15 to about 75 $lb/ft^3$, or from about 35 to about 50 $lb/ft^3$, or from about 50 $lb/ft^3$ to about 75 $lb/ft^3$. Still further, in certain aspects, the core layer can comprise one or more densified fiber batts. It is further understood that if more than one densified fiber batt are present in the core layer, each of the densified fiber batts can exhibit density that can be same or different from another densified batt. In still further aspects, the core layer can comprise one or more densified fiber batts exhibiting different density across the core layer.

In yet other aspects, the core layer is a non-vinyl resilient core layer.

In some aspects, the core layer can comprise a composite material formed from raw or unprocessed bamboo dust, wood dust, cork dust or a mixture thereof and a polymer. In some aspects, the core layer can comprise a composite material formed from raw or unprocessed bamboo dust, wood dust, cork dust or a mixture thereof and high density polyethylene (HDPE) or alternatively, virgin or recycled PVC. In other aspects, the polymer can be a combination of such virgin and recycled PVCs. In yet other aspects, the core layer can comprise various thermoplastic materials. In some aspects, the thermoplastic material is a polyolefin including polyethylene or polypropylene, and rigid polyvinyl chloride (PVC). In yet other aspects, semi-rigid or flexible polyvinyl chloride can also be used. In still further aspects, such composite material can comprise up to about 10% chemical additives such as anti-UV agents, anti-oxidation agents, stabilizers, colorants, anti-fungus agents, coupling agents, reinforcing agents, and lubricants. In yet other aspects, such composite material does not comprise an anti-UV agent, anti-fungal, and/or insecticide.

In yet other aspects, the core layer of the current disclosure can further comprise a filler. Exemplary and non-limiting fillers can include calcium carbonate, fly-ash, recycled calcium carbonate, aluminum trihydrate, talc, nano-clay, barium sulfate, barite, barite glass fiber, glass powder, glass cullet, metal powder, alumina, hydrated alumina, clay, magnesium carbonate, calcium sulfate, silica, glass, fumed silica, carbon black, graphite, cement dust, feldspar, nepheline, magnesium oxide, zinc oxide, aluminum silicate, calcium silicate, titanium dioxide, titanates, glass microspheres, chalk, calcium oxide, and any combination thereof. In some aspects, the filler content can be virgin. In other aspects, the filler content can be reclaimed. In certain aspects, the filler content can be reclaimed from post-consumer articles. In yet other aspects, the filler content can be reclaimed from post-industrial articles.

In certain aspects, the filler comprises one or more of calcium carbonate, aluminum trihydrate, barite, feldspar, cullet, fly ash, kaolin clay, limestone, polyurethane foam, rubber, thermoplastic powder, thermoplastic polyurethane (TPU), wollastonite, or any combination thereof.

In yet other aspects, the core layer can further comprise a pigment, a flame retardant, surfactant, processing aids, or a combination thereof. In certain aspects, the core layer can comprise one or more flame retardant components. Exemplary flame retardants that can be incorporated into the core layer include, without limitation, organo-phosphorous flame retardants, red phosphorous magnesium hydroxide, magnesium dihydroxide, hexabromocyclododecane, bromine containing flame retardants, brominated aromatic flame retardants, melamine cyanurate, melamine polyphosphate, melamine borate, methylol and its derivatives, silicon dioxide, calcium carbonate, resorcinol bis-(diphenyl phosphate), brominated latex base, antimony trioxide, strontium borate, strontium phosphate, monomeric N-alkoxy hindered amine (NOR HAS), triazine and its derivatives, high aspect ratio talc, phosphated esters, organically modified nanoclays and nanotubes, non-organically modified nanoclays and nanotubes, ammonium polyphosphate, polyphosphoric acid, ammonium salt, triaryl phosphates, isopropylated triphenyl phosphate, phosphate esters, magnesium hydroxide, zinc borate, bentonite (alkaline activated nanoclay and nanotubes), organoclays, aluminum trihydrate (ATH), azodicarbonamide, diazenedicarboxamide, azodicarbonic acid diamide (ADC), triaryl phosphates, isopropylated triphenyl phosphate, triazine derivatives, alkaline activated organoclay and aluminum oxide. Any desired amount of flame retardant can be used in the core layer and the selection of such amount will depend on a required application. Such amounts can be readily determined through no more than routine experimentation.

In other aspects, any pigments or surfactant known in the art can be utilized. In yet other aspects, any processing aids known in the art can be used. In some aspects, processing aids can include without limitation antistatic chemicals, lubricants, oils, or any combination thereof.

In certain aspects, the core layer can comprise a plurality of composite core layers. For example, the core layer can comprise a first core layer and a second core layer overlying the first core layer. It is understood that in the aspects where the first and the second core layers are present, each of the layers can be any layer described above. It is further understood that in the aspects where the first and the second core layers are present, the first and the second core layer can be the same or different. In some aspects, the first and the second core layers can be prepared from the same or different materials, have the same or different size, thickness, or density.

The core layer can have any desired thickness. For example, in some aspects the core layer can have a thickness in the range from about 1.5 mm to about 20 mm, including exemplary values of about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, and about 19 mm. In still further aspects, the core layer can have a thickness in any range between two foregoing values.

Veneer Layer

As described herein the flooring panels comprise a wood veneer layer. The veneer layer has a top surface and an opposing bottom surface, and is positioned such that the veneer layer overlies the tops surface of the core layer described above. In some aspects, the veneer layer comprises a hardwood veneer. In other aspects, the veneer layer can comprise an angiosperm wood veneer. In still further aspects, the veneer layer can comprise a gymnosperm wood veneer. It is understood that the wood veneers can be any type of species such as oak, maple, cherry, hickory, beech, pine, walnut, mahogany, chestnut, and teak and the like. In certain aspects, the veneer layer can be further decorated with a printed design to highlight the grains or knots or to mimic certain wood species or to emboss the surface to create vintage appearance and the like.

The veneer layer can be configured of any desired thickness. In exemplary aspects, the thickness of the veneer layer can be in the range of about 0.1 mm to about 5.0 mm, including exemplary values of about 0.5 mm, about 1.0 mm, about 1.2 mm, about 1.5 mm, about 1.8 mm, about 2.0 mm, about 2.2 mm, about 2.5 mm, about 2.8 mm, about 3.0 mm, about 3.2 mm, about 3.5 mm, about 3.8 mm, about 4.0 mm, about 4.2 mm, about 4.5 mm, about 4.8 mm, or about 5.0 mm. In still further aspects, the decorative veneer layer can have a thickness in any range between two foregoing values.

The veneer layer can be sliced veneer, rotary peeled, or sawn. The veneer layer can then be adhered to the top surface of the core layer by any known means, including for example, by the use of hot press adhesion.

Moisture Barrier Composition

With reference again to FIG. 1, at least one of the veneer layer top surface 106, the core layer bottom surface 114, the first pair of opposing side edges 120, and the second pair of opposing side edges further comprise a moisture barrier composition applied thereto. In an exemplary aspect, each of the veneer layer top surface 106, the core layer bottom surface 114, the first pair of opposing side edges 120, and the second pair of opposing side edges comprise a moisture barrier composition applied thereto.

Various methods can be used for applying the barrier composition to the desired surface(s) of the floor covering panels, as known. In a first aspect, a vacuum coating process may be utilized. In this aspect, a floor covering panel is passed through a machine that applies the barrier composition under pressure to one side of a respective edge of a floor covering panel. A vacuum is applied at an opposite side of the edge of the panel to remove excess barrier composition from the floor covering panel. Excess barrier composition is returned to a vessel for re-use. Use of such a vacuum coating method allows for precise application of the barrier composition to a floor covering panel by way of adjusting the pressure/vacuum ratios.

A further method that may be utilized to apply the barrier composition to the floor covering panel is the use of a roll coat applicator. In this method, several large diameter rollers are made to match the area to be coated on the floor covering panels. The barrier composition may be applied to the desired portion of the floor covering panels by a transfer roller that is supplied with the barrier composition from a supply reservoir. The application of the barrier composition can be precisely controlled by adjusting the parameters used in the application.

A further method of applying the barrier composition to the floor covering panels is achieved by use of a multi-spray head applicator. This method will allow application of the amount of barrier composition to the flooring profile with precision and accuracy. In this method, multiple spray applicators may be fitted with nozzles and situated to spray the barrier composition on selected portions of the side edges of a floor covering panel. The spray applicators may pulse at a high frequency to apply the barrier composition to the desired position on the floor covering panel, which pulsing action may also assist in keeping the spray head clean. The barrier composition is supplied to the spray head by means of a conventional pump system that draws the composition from a supply tank. Such spray application systems are known to those skilled in the art, and the spray applications are commercially available from manufacturers such as Spraymation, Inc. (Ft. Lauderdale, FL). Heated supply hoses can be used with the multi-spray head applicator when solid waxes at room temperature are to be applied. The solid wax is melted prior to application and the heated supply hoses maintains the wax in melted form. Some water borne and UV sealers have a more consistent viscosity when heated (e.g., to about 100 F) prior to application. Heated supply hoses can also be used with water borne sealers and/or UV sealers.

Other methods of applying the barrier composition may be utilized according to the invention, including other existing methods of applying the barrier composition, and including methods of applying the barrier composition that may be developed in the future.

The amount of barrier composition applied to the floor covering material is not critical, as long as the desired water barrier qualities are provided. Generally, about 0.1, 0.5, 1.0, 2.0, or 5.0 g of composition per 8"×48" (0.20×1.22 meters) board may provide the desired water barrier quality in the finished floor covering material.

As used herein, "barrier composition" means the composition comprising the active ingredient, i.e., the chemical material providing the primary barrier properties, and any solvent or diluent and other ingredients. In one aspect the active ingredient may be any material that is suitable for use to provide water resistance or oil resistance to a surface. To this end, the following non-exclusive list of materials may be utilized as the active ingredient in the barrier composition: a fluorochemical, metal stearate, oil, paraffin wax, acrylate (latex) polymer, urethane based compositions such as hot melt polyurethane reactives (PUR), hydro sealers, UV curable sealers, or a silicone polymer.

In one aspect of the present invention, the barrier composition does not comprise an organic solvent. Still further, the diluent for the active ingredient of the barrier composition comprises water or, in a further aspect, consists essentially of water. Yet further, the barrier composition comprises an emulsion or dispersion of the active ingredient in water. In a further aspect, the barrier composition is substantially non-flammable and may be utilized in an industrial setting without the use of explosion and fire proof equipment.

In particular, to obtain a durable barrier composition, use of a polymeric material may be desirable for use as the active ingredient. Non-exclusive examples of suitable polymers include silicone polymers, acrylate (latex) polymers, urethane polymers, and fluoropolymers. Such materials will generally have higher molecular weights and, as such, may allow a more durable deposition of the barrier composition to the floor covering panels. In separate aspects, the barrier composition provides a treatment that makes a floor covering material durable for at least about 6 months, or at least about 1 year, or at least about 5 years, or at least about 7 years, or at least about 12 years, or for the entire useful life of the floor covering system.

The barrier composition may comprise about 100% by weight of a composition comprising the active ingredient as supplied by the vendor, i.e. neat. The composition as supplied by a vendor may comprise any amount of active ingredient. However, such compositions are normally supplied as solutions or dispersions of water barrier chemicals in water or other solvents. As contemplated, the concentration of barrier chemicals as supplied by a vendor is not significant as long as the appropriate dilution may be obtained to provide the barrier compositions suitable for use in the present invention. Alternatively, the composition as provided may be diluted prior to use on the floor covering panels. Any suitable solvent may be used for the dilution but water results in a lesser environmental impact from industrial use of the active ingredient. Accordingly, the barrier composition may comprise water as a primary solvent.

The active ingredient for the barrier composition may, in some aspects, be crosslinkable. "Crosslinkable" means the active ingredient reacts with or condenses with itself to result in a final product with a molecular weight of at least about 1.5 times or about 2 times or about 3 times the molecular weight of the non-crosslinked active ingredient. The active ingredient may also be crosslinkable in conjunction with a second material, such as melamine/formaldehyde resin.

The active ingredient may be crosslinkable by application of energy to the barrier composition after application of the barrier composition to the floor covering panel. The energy can be applied by heat, infrared lamps, UV lamps, or microwave energy. The active ingredient may be crosslinkable by exposure to the atmosphere or water. The active ingredient may also be crosslinkable by inclusion of a crosslinker in the barrier composition. In separate aspects, the active ingredient is substantially crosslinked at the conclusion of the application of heat, however, it will be recognized that with time, some additional crosslinking may occur.

The final amount of active ingredient in the barrier composition may vary within a wide range. In particular, the amount of active ingredient (that is, the water barrier chemical) in the barrier composition may be about 1, 2, 5, 10, 15, 20, 25, 30, 40 or 50% or by weight of the barrier composition, with any value forming the upper and lower endpoint, as appropriate. The balance of materials in the barrier composition may primarily be water, along with a minor amount of other materials.

The barrier composition may include additives as are known to one of ordinary skill in the art. In particular, the barrier composition may include one or more additives selected from: surfactants, viscosity modifiers, preservatives, surface tension modifiers, colorants, or opacifiers, or combinations thereof. The one or more additives can comprise isocyanates to provide moisture resistance in resins, binders, coatings, adhesives, or isobornyl acrylate, which can be used in hydrophobic coatings, or silanes to provide additional water repellency.

As would be recognized by one of ordinary skill in the art, any dilution of the active ingredient will depend in large part on the type and amount of active ingredient in the composition as supplied by a manufacturer.

An important aspect of the present invention is that the barrier composition provides a water resistance or barrier treatment to a floor covering panel or floor covering panel system. Thus, in aspects where mateable side edges of corresponding floor panels are treated the barrier composition provides a treatment that will substantially reduce the possibility that water or other liquids will penetrate the seam of two mated floor covering panels as compared a similar seam of two mated floor covering panels in the absence of the barrier composition treatment. Still further, the barrier composition of the present invention should reduce the amount of water penetrating a top seam by at least ½ or ¾, even when the water comprises a small amount of surfactant, i.e., 1 weight percent of the water or less. Such reduction should last for at least about 10, or about 20, or about 40, or about 100 normal mopping cycles, where "normal mopping" corresponds to the cleaning that a floor covering panel system will undergo during normal residential use. Yet still further, the barrier composition of the present invention will provide a durable water barrier for one normal mopping cycle per week for about 1 year, or about 2 years, or about 5 years, or about 7 years, or about 12 years, or about as long as the normal useful life of the particular floor covering panel system.

As would be recognized by one of ordinary skill in the art, application of a barrier composition comprising one or more of the active ingredients disclosed herein will result in a reduction of the wettability of the surface of a floor covering panel. Since the wettability of the floor covering panel is lower, there will be a lesser possibility for water or other damaging materials to migrate through the seam of a mated pair of floor covering panels. This water barrier property is very important so as to allow floor covering materials to be used in locations that are commonly subjected to contact with water, such as bathrooms, kitchens and other areas.

Upon application of the barrier composition to the floor covering panels, energy, in the form of heat, UV or IR radiation, or microwave energy, may be applied to remove the solvent from the barrier composition and/or to provide crosslinking i.e., curing, of the active ingredient. The amount and form of energy and duration of the application of such energy will depend on the specific composition of the barrier composition applied.

The barrier composition can be applied to the respective desired portions of the flooring panels, i.e., the veneer top surface, core layer bottom surface, and respective opposed pair of side edges, in any desired sequence during the manufacturing process. For example, barrier composition to be applied to the core layer bottom surface can be applied after a veneer layer has been adhered to the core layer or before. Still further, this application can also occur after any subsequent milling to impart optional edge profiles, optional bevel portions, or even after the engineered floor panel has been cut to a predetermined width and length. Alternatively, the moisture barrier composition can be applied to the core layer bottom surface prior to application of the veneer layer. By way of example, according to this aspect, an exemplary UV curable hydrophobic sealer can be roll coated to one side of a core layer, such as an HDF layer, while the HDF is still in a raw panel form (a size of approximately 4 feet×5 feet or 5 feet×8 feet). The UV curable composition can then be cured. After curing, the treated HDF core layer can be cut down to a desired floor panel size and sliced hardwood veneer faces can then be hot pressed to the untreated opposite side of the HDF (face). Surprising, this sequence and the hot pressing process does not adversely affect the UV cured back sealer's moisture resistance. If the veneer to be applied is a rotary peeled or sawn veneer, the entire veneer sheet can be hot pressed onto the untreated opposing face of the raw HDF core layer and then the resulting composite can be ripped and cut to the desired floor panel size. Still further, any edge profiles can then be milled (i.e., a tongue and groove) without damaging the back coating. Of course, any barrier composition to be applied to opposing side edges having profiled or milled features such as a tongue and groove will be applied thereto after formation of the edge profile has been formed. As one of ordinary skill in the art will appreciate, this method sequence is more efficient and economical than the traditional method of applying a back coating after milling individual planks or applying it to planks just prior to milling. In another aspect, the barrier composition can comprise a hot melt wax that can be applied via either spray or vacuum coating. In yet another aspect, the barrier composition can comprise a water borne hydrophobic sealer that can be applied via spray application. In yet another aspect, the barrier composition can comprise a polyurethane reinforcement sealer that can be applied via spray application.

Application of barrier composition to the veneer layer can also occur at any desired sequence in the manufacturing process. For example, in some aspects, it may be desired to stain or paint the exposed surface of the wood veneer layer. This exposed surface can include not only the top surface but also any optional bevel surface that may be present. According to these aspects, it may be desirable to apply the moisture barrier composition after such staining or painting has occurred as such barrier composition may interfere with the staining or painting process. To that end, it should also be understood that in those aspects where an optional bevel portion is present, the barrier composition can be selectively applied to the opposed edge portions of the flooring panels such that it is not applied to the bevel surface. Alternatively, the barrier composition can be applied so that it is applied to the bevel surface.

Still further, it should be noted that any one or more of the surfaces having a barrier composition applied there to can each comprise the same barrier composition or, alternatively can each comprise a different barrier composition. For example, in one aspect, a UV cured sealer can be used to coat the veneer top surface and core layer bottom surface of the flooring panel disclosed herein while a wax based sealer can be used to coat tongue and groove profiles of the opposed pairs of side edges.

Enhanced Moisture Resistance

As one of ordinary skill in the art will appreciate, the presence of excessive moisture for prolonged periods of time can have negative effects on the usable life of engineered hardwood veneer flooring. For example, the effects of moisture can reduce dimensional stability, result in swelling, splintering, splits, face checking and even mold and mildew growth. As will be appreciated in view of this disclosure, the application of a moisture barrier composition as described herein that can effectively provide a moisture resistant hydrophobic seal on the various surfaces and interlocking edges and seams of an engineered hardwood flooring panel can advantageously increase resistance to such moisture.

For example, the engineered hardwood veneer floor panels described herein can withstand topical spills for longer periods of time without developing adverse conditions resulting from the spill. This can allow for more time to clean such spills before any damage might occur. Further, the moisture resistant coatings in combination with relatively tight fitting click lock side edge profiles can also minimize or even prevent moisture from seeping through seems and becoming trapped between the flooring panel and the subfloor structure. Still further, the sealed floor panels can exhibit higher resistance to higher than normal subfloor moisture, and higher than normal ambient humidity.

These various advantages and improvement in resistance to moisture can be observed and evaluated using a number of testing protocols. For example, moisture tests can include cobb ring analysis, water soak or swell analysis, humidity dome analysis, and wet mop analysis. The tightness and moisture resistance of flooring seams or end joints can be analyzed using a putty dam test. These and other tests, and the relative improvement that a barrier composition as described herein can provide, are further exemplified below.

Moisture Resistance Testing

The following moisture tests were done in the development of the moisture resistant engineered wood flooring disclosed herein. Various sealers were tested against control boards using: i. Cobb ring test; ii. water soak test; iii. humidity dome test; iv. and wet mop tests. The control boards do not have a hydrophobic sealer.

i. Cobb Ring Test

The cobb ring test is a modified version of ASTM D5795. It measures the amount of water that penetrates into the face of the tested board. The cobb ring test is conducted using the following procedure: Silicone, place a 1" tall section of 4" PVC pipe (ring) onto the board to be tested. The test boards are acclimated in the test environment for at least 3 days. The initial weight of the test board with attached ring was recorded (use scale accurate to within 0.01 g). Another PVC ring was placed underneath the test board sample to keep the sample elevated from the surface. This is to prevent contamination of adjacent test boards if one of the samples leak. 100 mL of water was added inside the 4" PVC pipe (ring). After 24 hours, the water was dumped from ring into a bucket. The surface of the test board was dried and reweighed. The moisture gain of the test board is recorded and converted to grams per square meter ($g/m^2$).

Figure 4:
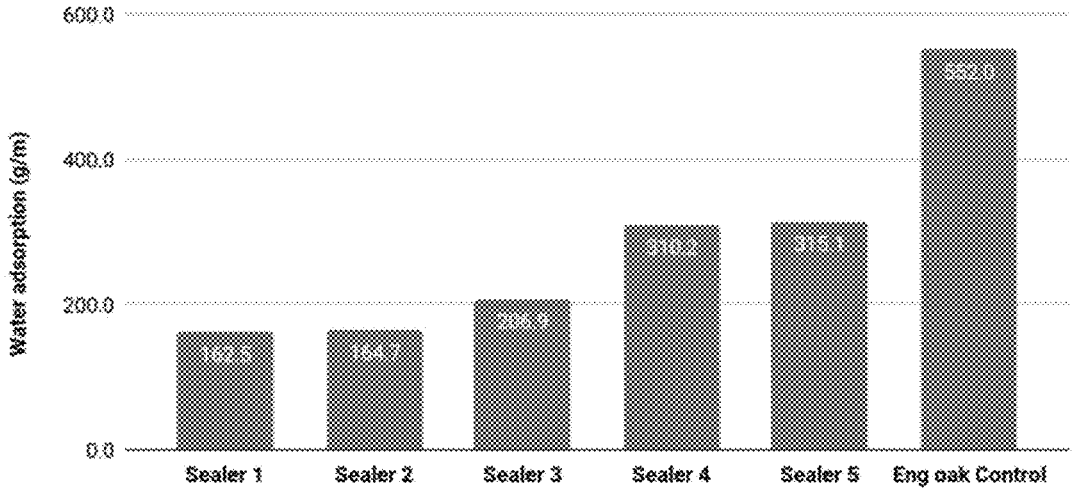
FIG. 4 depicts cobb ring test results for sealers on unfinished red oak.
Figure 5:
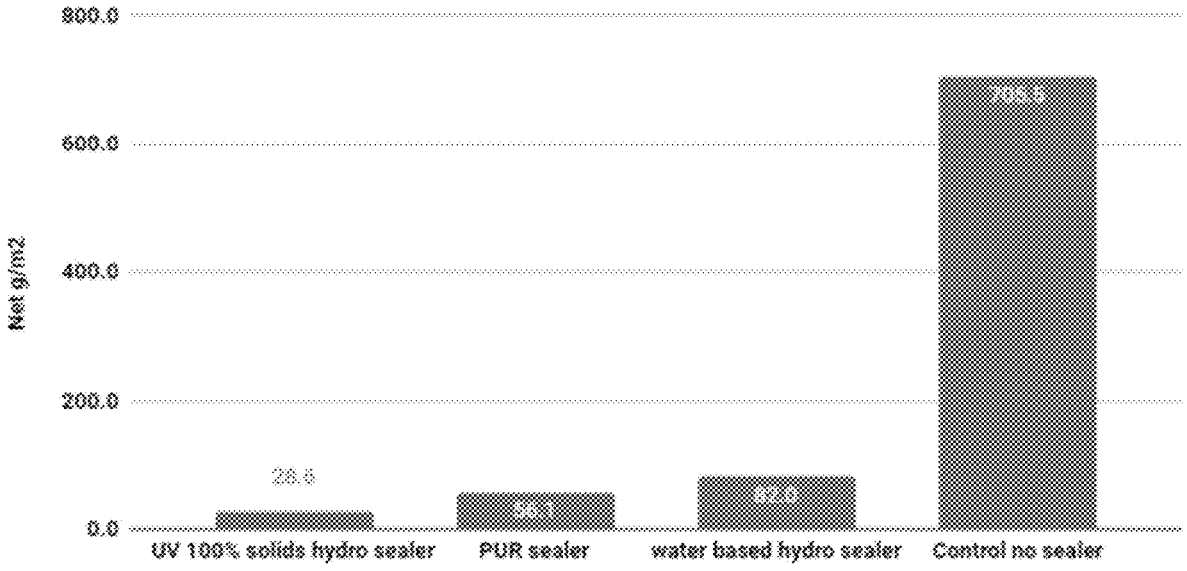
FIG. 5 depicts cobb ring test results for sealers on raw HDF.

The results of the cobb ring test are shown in FIGS. 4 and 5. FIG. 4 shows data for sealers 1-5 (sealer 1 is a water borne polyurethane; sealer 2 is a water borne urethane/wax emulsion; sealer 3 is a water borne polyurethane; sealer 4 is a methacrylate copolymer solution) on unfinished engineered oak. FIG. 5 shows data for sealers on raw HDF.

ii. Water Soak/Swell Tests

The water soak test was used to compare various hydrophobic sealers and wood substrates. The water soak/swell tests were conducted using the following procedure: The initial test board weight (grams), thickness (micrometer), width and length (caliper) was recorded. The test board was either partially or fully submerged in water for 24 hours. The surface of the test board was dried and the board weight (grams), thickness (micrometer), width and length (caliper) was re-recorded.

A "Swellometer" fixture was developed from the Window & Door Manuf. Assoc. WDMA T.M. 2-15 Test Method. The swellometer is used to measure the effectiveness of water-repellents in retarding dimensional changes of wood exposed (submerged) to water. There is a dial indicator on the swellometer that provides the visual width swell measurement over time.

Figure 6:
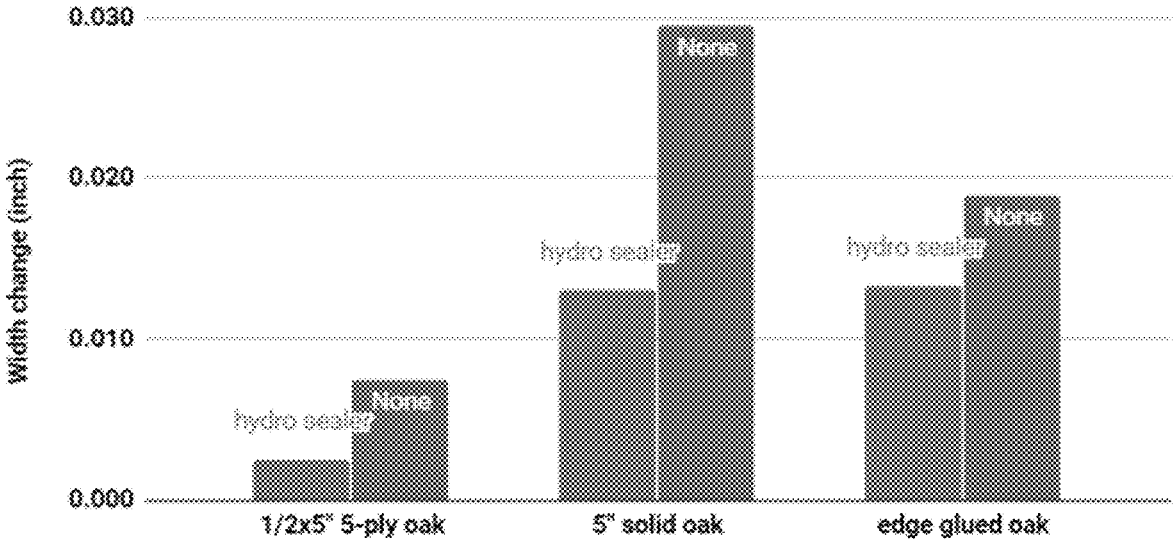
FIG. 6 depicts swellometer 24 hour soak test results of boards with vs without hydrophobic sealer (width change).
Figure 7:
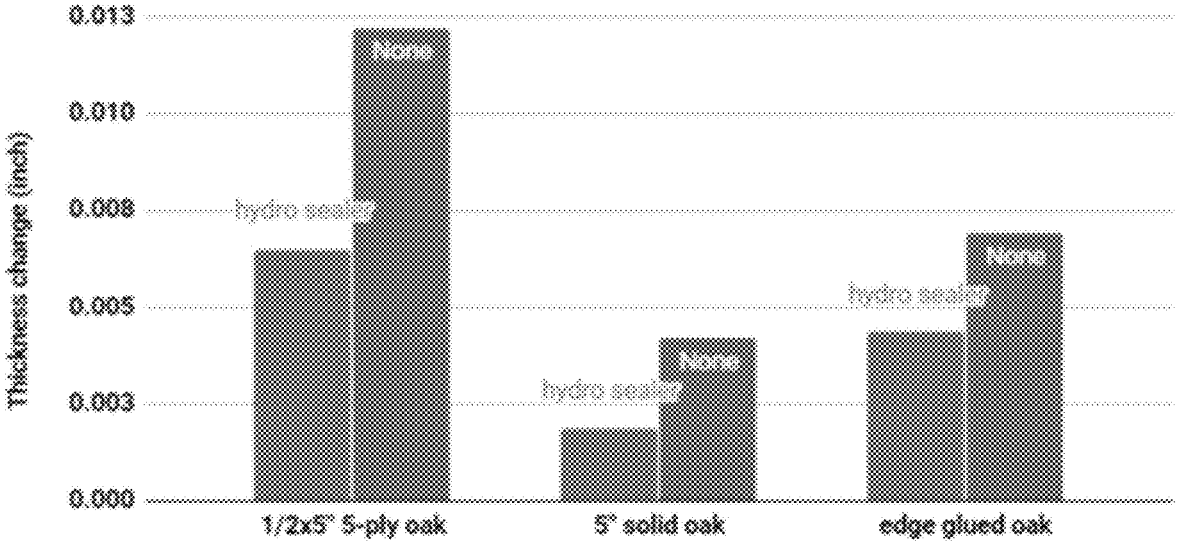
FIG. 7 depicts swellometer 24 hour soak test results of boards with vs without hydrophobic sealer (thickness change).

The results of the water soak/swell tests are shown in FIGS. 6 and 7. FIG. 6 shows data for swellometer test width change on solid and 5-ply oak for hydrophobic sealer. FIG. 7 shows data for swellometer test thickness changes on solid and 5-ply oak for a hydrophobic sealer.

Figure 8:
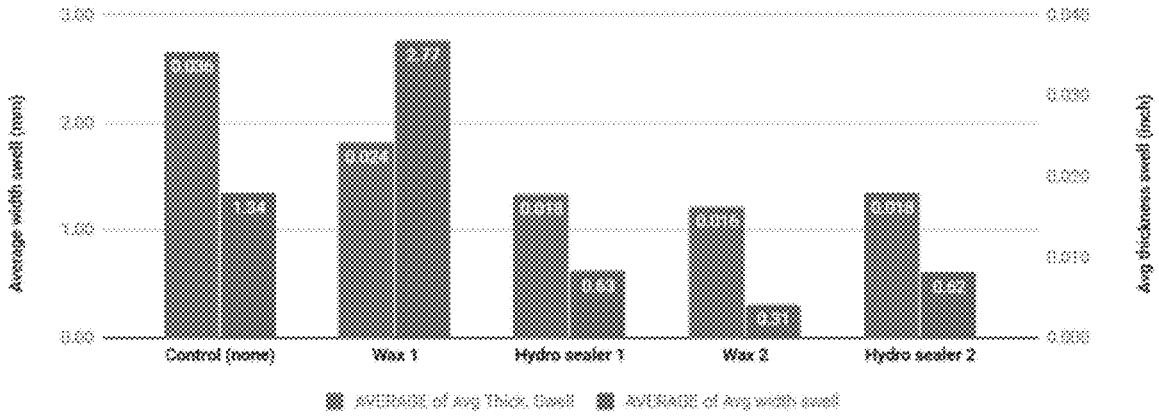
FIG. 8 depicts the results of a partial water soak test in solid red oak comparing 2 water based hydrophobic sealers and 2 waxes.

Tests boards treated with wax or hydrophobic sealer were partially submerged in water for 24 hours. The wax 1 allowed water to get into the wood after the wax cracked, but did not readily allow water to escape. In this case, the width swell is worse than the control. Wax 2 did not crack and performed much better. However, it was difficult to apply wax onto the wood in a cost effective manner (typically needs to be vacuum coated using expensive equipment that heats the wax). Traditional wax spray guns with heated lines (e.g., Nordson) cannot provide an accurate spray coverage. FIG. 8 shows the average width and thickness swell of the test boards after 24 hours in water. In FIG. 8, the average thickness swelling is shown in the left columns for each data set (control, wax, hydro sealer 1, wax 2, and hydro sealer 2), and the average width swelling is shown in the right columns for each data set (control, wax, hydro sealer 1, wax 2, and hydro sealer 2).

A putty dam test were performed on board seams. The putty dam test is to measure the tightness of seams on laminate and engineered wood flooring with locking or "click" tongue and groove profiles. The putty dam test was conducted using the following procedure: Four test boards were used that were engaged using two short sides and two long side boards. The boards were engaged to provide for tight seams. A T intersection of two short side boards and one long side board was selected for testing. A feeler gauge was used to measure the gaps between seams. An indicator was used to measure the seam height. Plumbers putty was applied around the outside of a 3" PVC pipe, which was placed in the T intersection. The veneer seams were sealed tight by pressing down on the putty to improve the water tightness. 30 mL of water colored with red food dye was added inside the PVC pipe. The time the water was added was recorded, and time any water started to leak and the location of leakage was recorded. The test was stopped when either all the water had seeped out or after 24 hours (whichever came first). The test boards were dried. The PVC ring and the putty was removed. The tests boards were disassembled and inspected for water infiltration.

Figure 9:
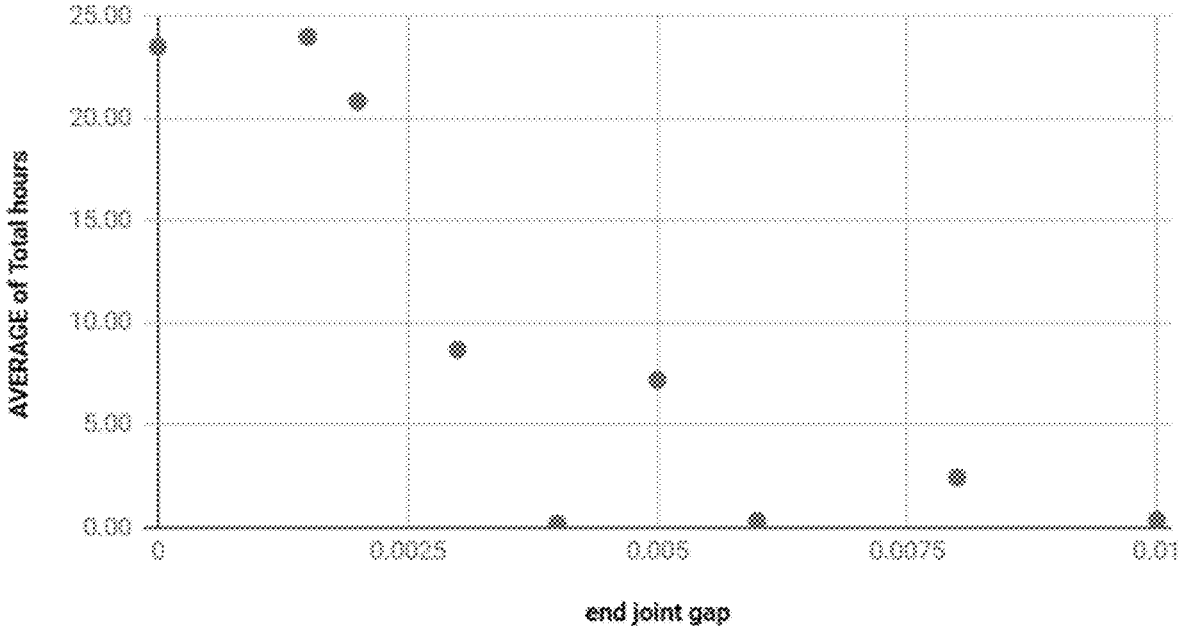
FIG. 9 depicts the results from a putty dam test.

FIG. 9 shows the results from the putty dam test. The results of the putty dam test depend heavily on the tightness of seams between adjacent boards. The tighter the seam, the longer the boards held water. There was no significant difference between boards with a sprayed hydrophobic sealer compared to boards with a water based stain (5-10% solids content).

iii. Humidity Dome Test

The humidity dome test was used to evaluate the effect of water vapor on the swelling and moisture gain of test boards treated with vs without the hydrophobic sealer. A fiber-cement board (Hardibacker) was installed over an enclosed pool of water. There was a gap of at least 8" between the bottom of the fiber-cement board and the water. Water vapor was allowed to rise through the fiber-cement board into the plastic dome. PVC rings were placed to suspend the wood samples above the fiber-cement board. An equal amount of control vs hydrophobic sealer samples were placed in rows under the dome. Such an arrangement ensures that test boards on the damper bottom row do not skew the overall results.

Figure 10:
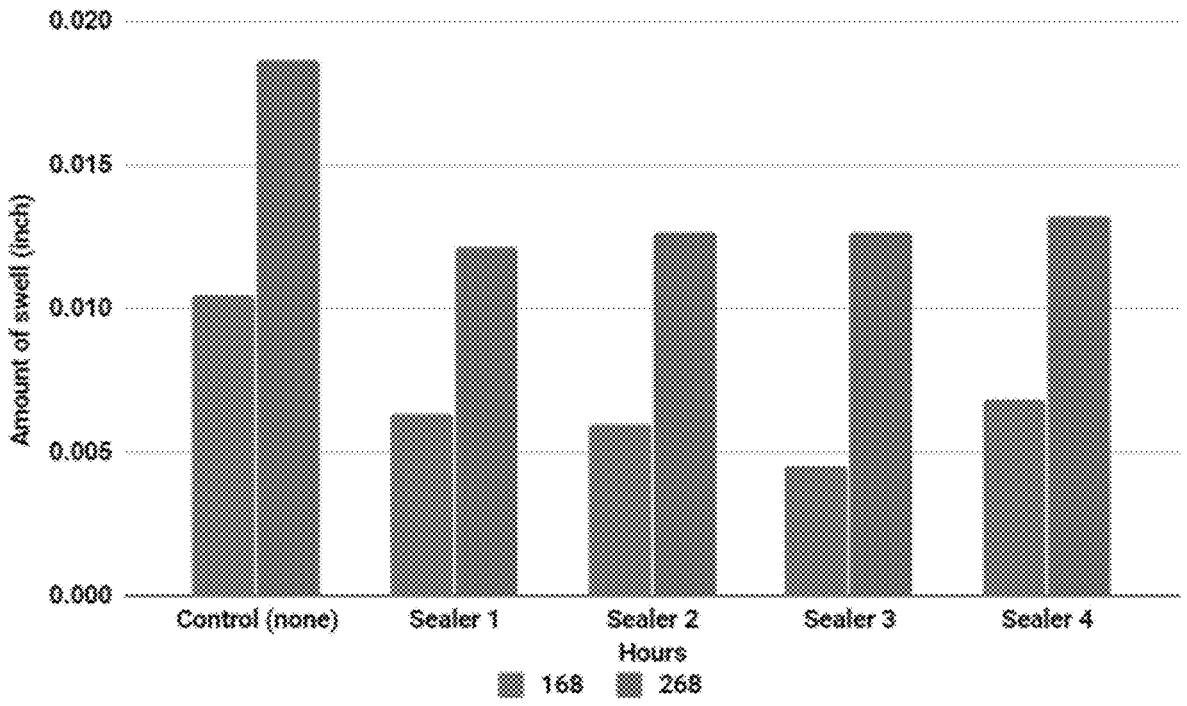
FIG. 10 depicts thickness swell test results of boards with various sealers under humidity dome on solid hickory.
Figure 11:
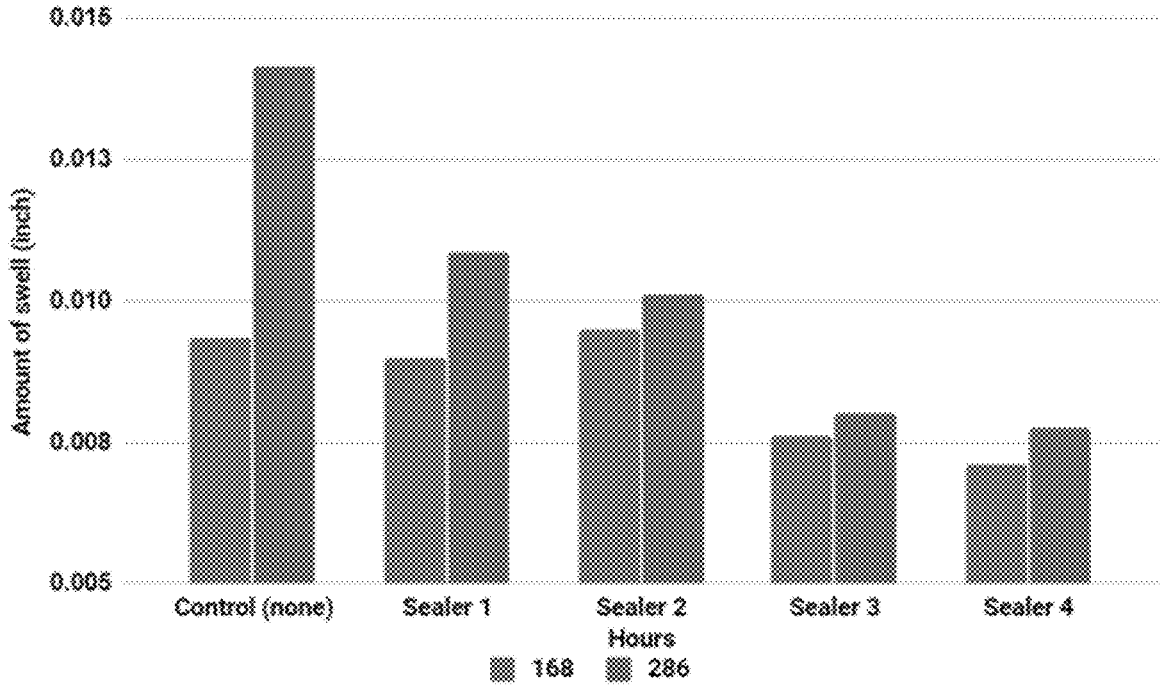
FIG. 11 depicts thickness swell test results of boards with various sealers under humidity dome on solid oak.
Figure 12:
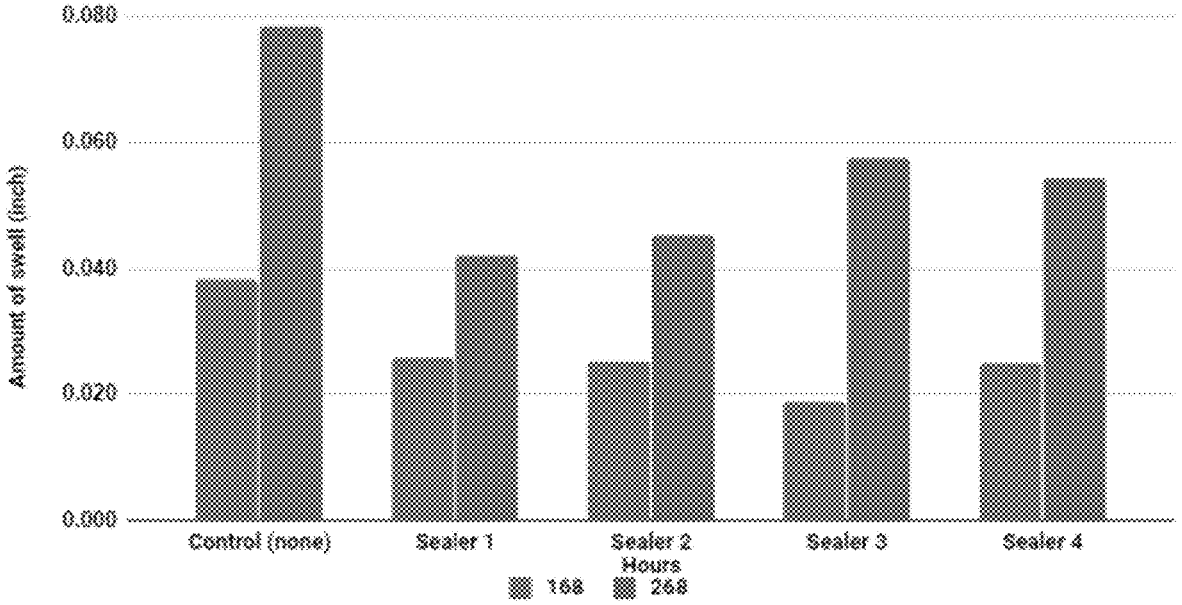
FIG. 12 depicts width swell test results of boards with various sealers under humidity dome on solid hickory.
Figure 13:
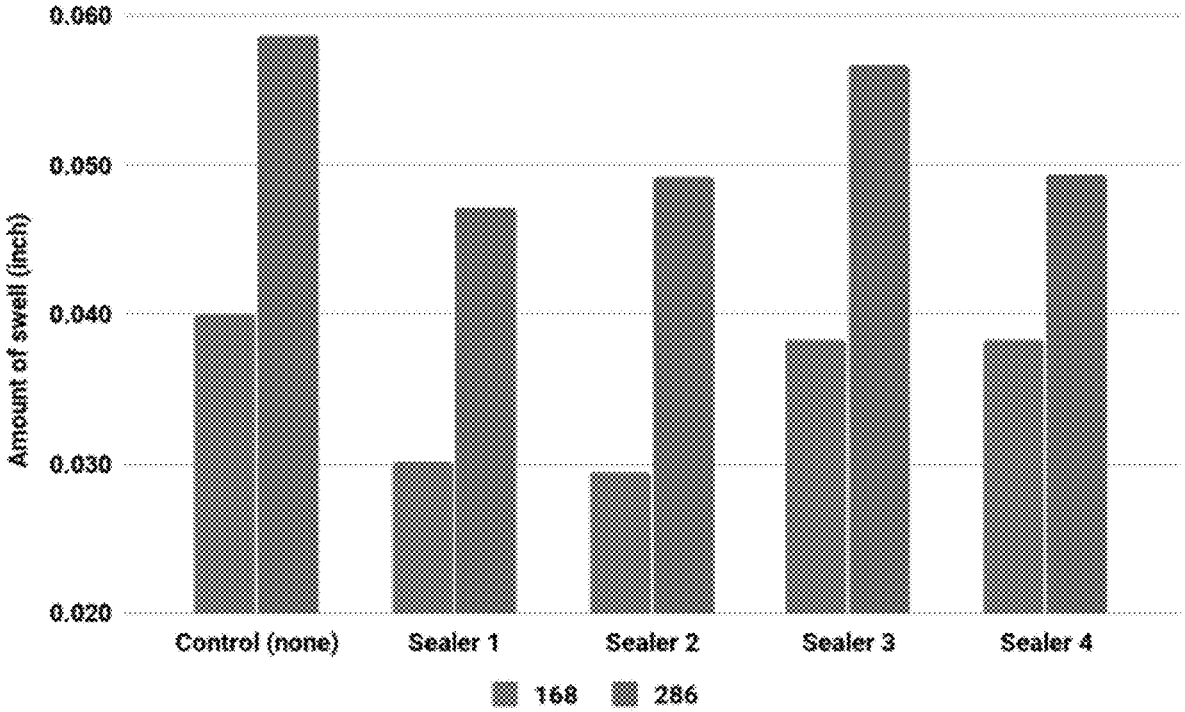
FIG. 13 depicts width swell test results of boards with various sealers under humidity dome on solid oak.

FIGS. 10-13 shows the results of the humidity dome test after 168 and 268 hours of exposure to humidity. FIG. 10 shows thickness swell test results of boards with various sealers under humidity dome on 4" solid hickory at 168 hours and 268 hours. In FIG. 10, the data for 168 hours is shown in the left columns for each data set (control, sealer 1, sealer 2, sealer, 3, and sealer 4), and the data for 268 hours is shown in the right columns for each data set (control, wax, hydro sealer 1, wax 2, and hydro sealer 2). FIG. 11 shows thickness swell test results of boards with various sealers under humidity dome on 5" solid oak at 168 hours and 286 hours. In FIG. 11, the data for 168 hours is shown in the left columns for each data set (control, sealer 1, sealer 2, sealer, 3, and sealer 4), and the data for 286 hours is shown in the right columns for each data set (control, wax, hydro sealer 1, wax 2, and hydro sealer 2). FIG. 12 shows width swell test results of boards with various sealers under humidity dome on 4" solid hickory at 168 hours and 268 hours. In FIG. 12, the data for 168 hours is shown in the left columns for each data set (control, sealer 1, sealer 2, sealer, 3, and sealer 4), and the data for 268 hours is shown in the right columns for each data set (control, wax, hydro sealer 1, wax 2, and hydro sealer 2). FIG. 13 shows width swell test results of boards with various sealers under humidity dome on 5" solid oak at 168 and 286. In FIG. 13, the data for 168 hours is shown in the left columns for each data set (control, sealer 1, sealer 2, sealer, 3, and sealer 4), and the data for 286 hours is shown in the right columns for each data set (control, wax, hydro sealer 1, wax 2, and hydro sealer 2).

iv. Wet Mop Tests

Figure 14:
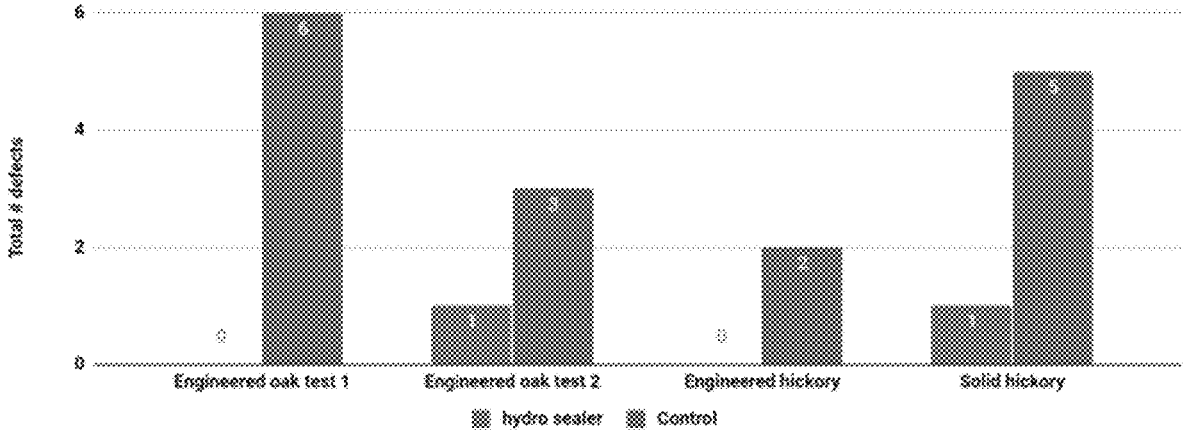
FIG. 14 depicts the results for the wet mopping test with a hydrophobic sealer.

Wet and dry mop tests were conducted on engineered and solid boards with vs without the hydrophobic sealer using the following process: Test boards were mopped using "Swiffer®" sheets. Test boards were mopped with a wet sponge. The test boards were inspected for defects, such as splits, checks, etc. Defects are classify and recorded. The mopping process was repeated every work day for three months. Defects are classified and recorded over the three months. FIG. 14 shows the results for the wet mopping test with a hydrophobic sealer. The data in FIG. 14 shows the number of defects caused by the wet mopping on each surface. In FIG. 14, the data related to the hydro sealer is shown in the left columns for each data set (engineered oak test 1, engineered oak test 2, engineered hickory, and solid hickory), and the data related to the control is shown in the right columns for each data set (engineered oak test 1, engineered oak test 2, engineered hickory, and solid hickory).

Dry mopping with Swiffer® style cloth sheets can catch areas of wood that have been weakened by continual wet mopping (especially corners and ends of boards). The sheets can catch a small raised area next to a split. If the mopping was done with enough force, then this small split can turn into a large splinter as the tensile strength of these sheets is relatively strong. Microfiber pads are more forgiving on hardwood floors as they do not catch corners as often as other pads.

v. Effect of Moisture Resistant Sealer on Mold

In general, mold will not grow on wood unless the moisture content is greater than 20%. Control and test boards with hydrophobic sealer were subjected to an environmental chamber set at 100 F and 97% relative humidity for 7 days. Control boards had mold growth, while the test boards with hydrophobic sealer did not have any mold growth.

vi. Sealer Application Methods

In a production environment, sealers can be applied via spray guns brushes, or roll coaters. UV cured sealers are typically applied via a roll coater followed by UV curing lamps (e.g., Dubois Equipment, Jasper IN). Wax can be applied via vacuum coater or a spray gun (entire line must be heated above the wax's melting point). Water based sealers can be roll coated, brushed, or sprayed onto wood. In general, the higher the solids content, the more effective the sealer and more difficult to spray without clogging nozzles (sealer often requires constant agitation). Another sealer application method is the impregnation or infusion of the veneer by autoclave or pressure vessel.

Roll coating can be an efficient method for applying sealers to board faces and backs. A hydrophobic sealer can be added to the normal processing steps of an industrial finish line (typically after the stain and before the final top coat). Other sealers (e.g., high taber sealer) are often used in the coating process to provide scratch resistance. The hydrophobic sealer is an additional step that can increase gloss levels making the board appear shinier.

The tongue and groove edge profiles can be coated via vacuum coaters (e.g., Cefla) or spray guns (e.g., Graco). The sealers needs to be applied to both the long and short side profiles (all 4 sides). Spray guns must be positioned accurately and the wood must be controlled as it passes the nozzles. Photo-eye triggers should be set to accurately start and stop the spraying as boards pass by the nozzles. Fluid atomization must be set correctly to get the proper spray density and coverage. If the sealer gets on the face or bevel of the board, then sanding is needed to insure that stain and other finish chemistries absorb evenly into the wood. This can be a problem on distressed boards (e.g., hand scraped, wire brushed) that get de-nibbed but not fully sanded (don't want to sand away the distress marks).

The invention claimed is:

1. A flooring panel comprising:

a decorative veneer layer and a core layer, the decorative veneer layer and the core layer having respective top surfaces and opposed bottom surfaces, wherein the opposed bottom surface of the decorative veneer layer overlies the top surface of the core layer, wherein the flooring panel comprises:

a first pair of opposing side edges extending between the opposed bottom surface of the core layer and the top surface of the decorative veneer layer; and a second pair of opposing side edges that extend between the opposed bottom surface of the core layer and the top surface of the decorative veneer layer, wherein one or more of the top surface of the decorative veneer layer, the opposed bottom surface of the core layer, the first pair of opposing side edges, and the second pair of opposing side edges further comprises a 100% solid UV cured moisture barrier composition at a quantity from about 0.1 g to about 5.0 g per 2.67 sq.ft of the flooring panel.

2. The flooring panel of claim 1, wherein opposing side edges of the first and second pairs of opposing side edges are not profiled to define any form of an interlocking or other connecting or fastening mechanism by which adjacent floor covering boards can be attached to one another, and wherein the flooring panel has a water absorption rate of 162-315 $g/m^2$ and moisture gain of 28-82 $g/m^2$.

3. The flooring panel of claim 1, wherein opposing side edges of the first and second pairs of opposing side edges comprise connecting structures.

4. The flooring panel of claim 3, wherein the first pair of opposing side edges define a complementary connecting structure.

5. The flooring panel of claim 3, wherein a first side edge of the first pair of opposing side edges defines a tongue structure, and wherein a second side edge of the first pair of opposing side edges defines a groove structure.

6. The flooring panel of claim 3, wherein the second pair of opposing side edges defines a complementary connecting structure.

7. The flooring panel of claim 6, wherein a first side edge of the second pair of opposing side edges defines a tongue structure, and wherein a second side edge of the second pair of opposing side edges define a groove structure.

8. The flooring panel of claim 1, wherein the top surface of the decorative veneer layer comprises the 100% solid UV cured moisture barrier composition, and wherein the first pair of opposing side edges and the second pair of opposing side edges comprises a moisture barrier composition that is not a 100% solid UV cured moisture barrier composition.

9. The flooring panel of claim 1, wherein the core layer comprises a plurality of core layers.

10. The flooring panel of claim 1, wherein the core layer is one of a rigid core layer, semi-rigid core layer, and flexible core layer; and wherein a thickness of the core layer ranges from 1.5 mm to 20 mm.

11. The flooring panel of claim 1, wherein the decorative veneer layer is a decorative wood veneer layer.

12. A method comprising:

forming a flooring panel by applying a decorative veneer layer to a core layer, the decorative veneer layer and the core layer having respective top surfaces and opposed bottom surfaces, such that the opposed bottom surface of the decorative veneer layer overlies the top surface of the core layer and such that a first pair of opposing side edges extends between an opposed bottom surface of the core layer and a top surface of the decorative veneer layer and a second pair of opposing side edges extends between the opposed bottom surface of the core layer and the top surface of the decorative veneer layer;

applying a 100% solid UV curable moisture barrier composition to one or more of the top surface of the decorative veneer layer, the opposed bottom surface of the core layer, the first pair of opposing side edges, and the second pair of opposing side edges at a quantity from about 0.1 g to about 5.0 g per 2.67 sq.ft of the flooring panel; and curing the applied 100% solid UV curable moisture barrier composition, thereby producing the 100% solid UV cured moisture barrier at a quantity from about 0.1 g to about 5.0 g per 2.67 sq.ft of the flooring panel.

13. The method of claim 12, wherein the 100% solid UV curable moisture barrier composition is applied to the opposed bottom surface of the core layer after the decorative veneer layer has been adhered to the core layer.

14. The method of claim 12, wherein the 100% solid UV curable moisture barrier composition is applied to the bottom surface of the core layer before the decorative veneer layer has been adhered to the core layer.

15. The method of claim 12, wherein the 100% solid UV curable moisture barrier composition is a 100% solid UV curable hydrophobic sealer, and wherein the 100% solid UV curable moisture barrier composition is applied in a single pass at production speed.

16. The method of claim 12, wherein the core layer is a high-density fiberboard (HDF), and wherein the 100% solid UV curable moisture barrier composition is roll coated onto the core layer while the HDF is in raw panel form.

17. The method of claim 12, further comprising cutting the core layer to a desired floor panel size.

18. The method of claim 14, further comprising hot-pressing the decorative veneer layer to the top surface of the core layer, wherein the decorative veneer layer has a hardwood, softwood, or woody grass veneer face.

19. The method of claim 18, wherein the hot-pressing does not decrease moisture resistance of the 100% solid UV curable moisture barrier composition.

* * * * *